US005330113A

United States Patent [19]

Poser et al.

[11] Patent Number: 5,330,113

[45] Date of Patent: Jul. 19, 1994

[54] UNDERDRIVEN SIZE REDUCTION MACHINE

[75] Inventors: Kimberly J. Poser; Benjamin K. Murugesu, both of Kitchener, Canada

[73] Assignee: Quadro Engineering Inc., Waterloo, Canada

[21] Appl. No.: 37,840

[22] Filed: Mar. 29, 1993

[51] Int. Cl.[5] ..... B02C 19/08

[52] U.S. Cl. ..... 241/74; 241/89.2; 241/199.12; 241/285.1

[58] Field of Search ..... 241/74, 89.2, 199.12, 241/259, 285.1

[56] References Cited

U.S. PATENT DOCUMENTS

| | | | |
|---|---|---|---|
| 2,780,417 | 2/1957 | Harris | 241/285.1 |
| 3,693,893 | 9/1972 | McIntyre | 241/258 |
| 4,611,766 | 9/1986 | Seifert | 241/207 |
| 4,759,507 | 7/1988 | Lynch et al. | 241/69 |
| 4,768,722 | 9/1988 | Lynch et al. | 241/69 |
| 4,773,599 | 9/1988 | Lynch et al. | 241/69 |
| 5,261,612 | 11/1993 | Ftaiha | 241/2 |

FOREIGN PATENT DOCUMENTS 3617175 4/1987 Fed. Rep. of Germany .

*Primary Examiner*—Mark Rosenbaum
*Assistant Examiner*—John M. Husar
*Attorney, Agent, or Firm*—Jeffrey T. Imai; Arne I. Fors; D. Doak Horne

[57] ABSTRACT

A size reduction machine for use in process industries to continuously and precisely reduce the size of particles, while controlling fines, comprises an impeller mounted on a rotatable shaft, a drive operably connected to the shaft for effecting rotation of the shaft. The shaft and impeller are vertically mounted within a vertically extending channel having an input and an output. A screen has a tapered apertured wall formed in a frustoconical shape. The screen is rigidly mounted within the channel so that any particles passing from the input to the output pass through the screen. The impeller is shaped and mounted so that a gap between an edge of the impeller and an interior of the screen remains substantially constant as the impeller rotates relative to the screen. The improvement comprises the drive being operably connected to the shaft at a point under where the impeller is mounted onto the shaft.

8 Claims, 4 Drawing Sheets

UNDERDRIVEN SIZE REDUCTION MACHINE

FIELD OF THE INVENTION

This invention relates to a size reduction machine. In particular, this invention relates to a size reduction machine having a drive connected through an enclosed gearbox for driving the impeller thereunder.

BACKGROUND OF INVENTION

Size reduction machines are widely used in the production of pharmaceuticals and cosmetics. The pharmaceutical or cosmetic is manufactured and then size reduced into a granular or fine powder form. The pharmaceutical and cosmetic industries have very strict sanitary standards for operation and production. Size reduction machines must be capable of being fully sanitized before it can be used in such environments.

Size reduction machines of the prior art utilize a frusto-conical shaped screen located in a channel between an input and an output. Such size reduction machines are more particularly described in U.S. Pat. No. 4,759,507. In these machines, various screens and impellers are used to reduce the size of the particles. The choice of screen and impeller depends on the size and type of product that is being processed. The screens can have apertures in different sizes and shapes to produce a desired milled product.

The size reduction machines of the prior art are driven by a motor operably connected to a shaft on which the impeller is mounted. The drive is transmitted normally by means of a plurality of belts. However, some size reduction machine have shaft drives. One such machine is described in German patent no. 36 17 175.

Regardless of the type of drive, heretofore the drive to the impeller has been applied to the shaft above the impeller. As a result, the input of material to be milled must be offset from the vertical axis of the machine. Hoppers and feed pipes must be used to direct the material from an input, about the drive and into the impeller region. The redirecting of material is inefficient and more importantly such prior art machines require more height than other types of mills.

The principal reason that the drive of a size reduction machine is mounted above the impeller is to remove the drive from the path of the material to be milled. By passing the material around the drive, the drive is outside of the sanitary region of the machine. These machines can therefore meet the industry standards for sanitation set by various regulatory bodies, including the Food and Drug Administration in the United States.

The physical size of the size reduction machine plays an important role when the size reduction machine is being installed in an existing material processing system as a replacement for another type of mill. If the size reduction machine is physically too large, it cannot be used as a replacement machine for other types of size reduction machines.

In German patent no. 36 17 175, the shaft drive is above the impeller and is fully enclosed permitting the drive to remain in the direct flow of the material to be milled. However since the material to be milled has very low kinetic energy before it enters the impeller region, the input to the impeller region can become jammed allowing the material to bridge over the input.

A paddle is required to be mounted on the spindle to prevent such bridging of material.

SUMMARY OF THE INVENTION

The disadvantages of the prior art may be overcome by providing an underdriven size reduction machine having a drive which is fully enclosed in order to maintain a sanitary environment for the material to be milled.

It is desirable to provide a size reduction machine with a means for removing the machine out of the path of milling material for providing access to the machine for full and proper cleaning thereof.

According to one aspect of the invention there is provided a size reduction machine for use in process industries to continuously and precisely reduce the size of particles, while controlling fines. The size reduction machine comprises an impeller mounted on a rotatable shaft, a drive operably connected to the shaft for effecting rotation of the shaft. The shaft and impeller are vertically mounted within a vertically extending channel having an input and an output. A screen has a tapered apertured wall formed in a frusto-conical shape. The screen is rigidly mounted within the channel so that any particles passing from the input to the output pass through the screen. The impeller is shaped and mounted so that a gap between an edge of the impeller and an interior of the screen remains substantially constant as the impeller rotates relative to the screen. The improvement comprises the drive being operably connected to the shaft at a point under where the impeller is mounted onto the shaft.

According to another aspect of the invention, the drive is fully enclosed and sealed within a gearbox housing, substantially preventing ingress and egress of the particles into and out of the gearbox housing.

According to another aspect of the invention, the gearbox housing comprises a hollow body having an upper end having a bore and an internal counterbore, a lower end having a sealable and opening, a cap for closing said opening, a side wall having an opening for sealingly receiving a drive shaft of the drive means, a lip seal fitted within the bore for sealingly engaging the shaft, a first racer bearing fitted within the internal counterbore, a second racer bearing fitted with the opening, whereby the shaft is rotatably mounted within the first and second racer bearings and the drive shaft drivingly engages the shaft.

According to still yet another aspect of the invention, the screen has a narrow end having an apex aperture adapted to frictionally fit about the upper end of the gearbox for closing the narrow end.

According to still yet another aspect of the invention, the impeller has a base having a circular disc for directing flow of the particles outwardly towards the screen as the impeller rotates.

DETAILED DESCRIPTION OF THE DRAWINGS

In figures which illustrate embodiments of the invention,

DETAILED DESCRIPTION OF THE INVENTION

Figures 1, 1A:
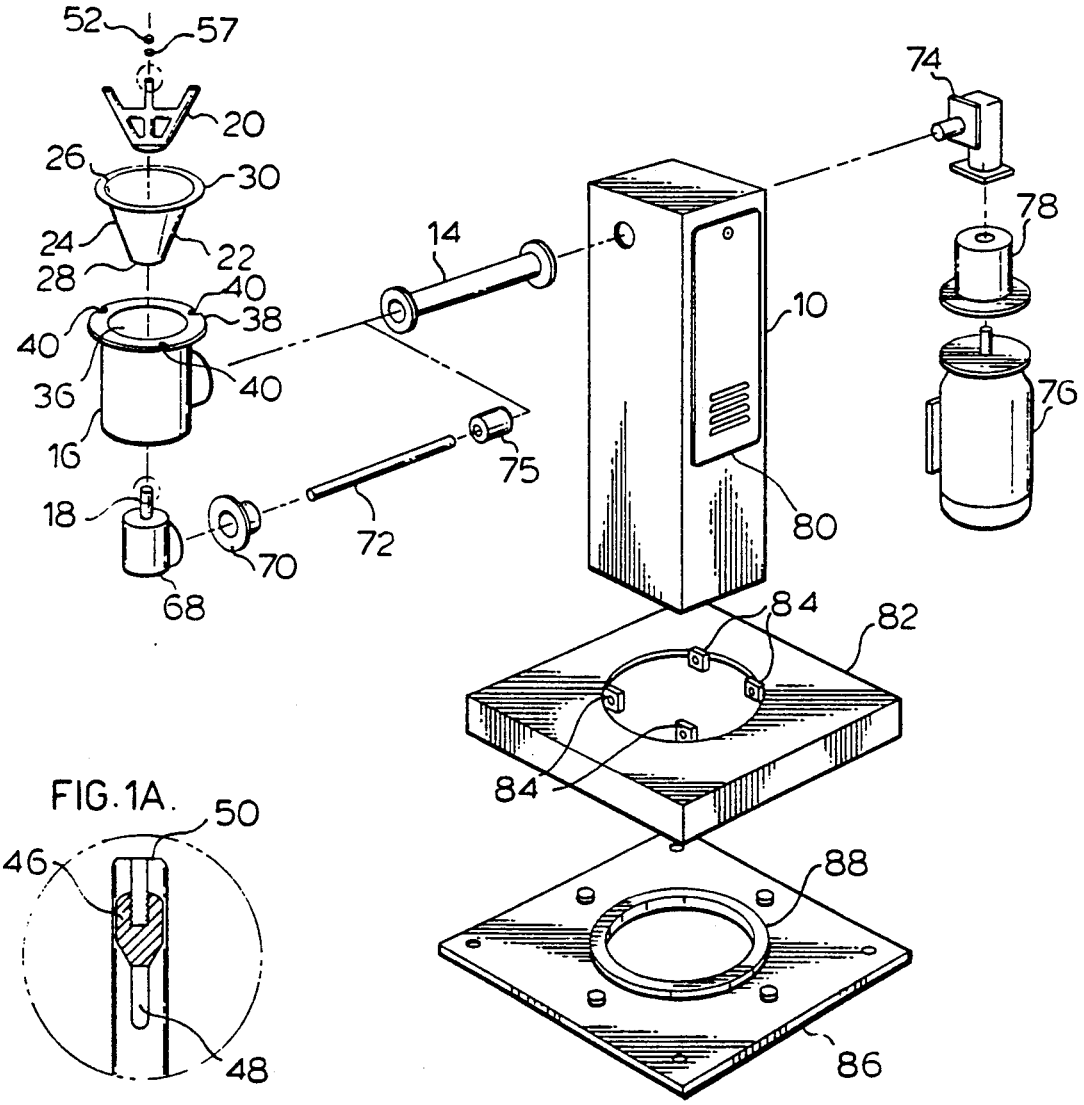
FIG. 1 is an exploded perspective view of the size reduction machine of the prescnt invention.
FIG. 1A is a front elevational view, partially in section, of the end of thespindle of the invention of FIG. 1.
Figure 2:
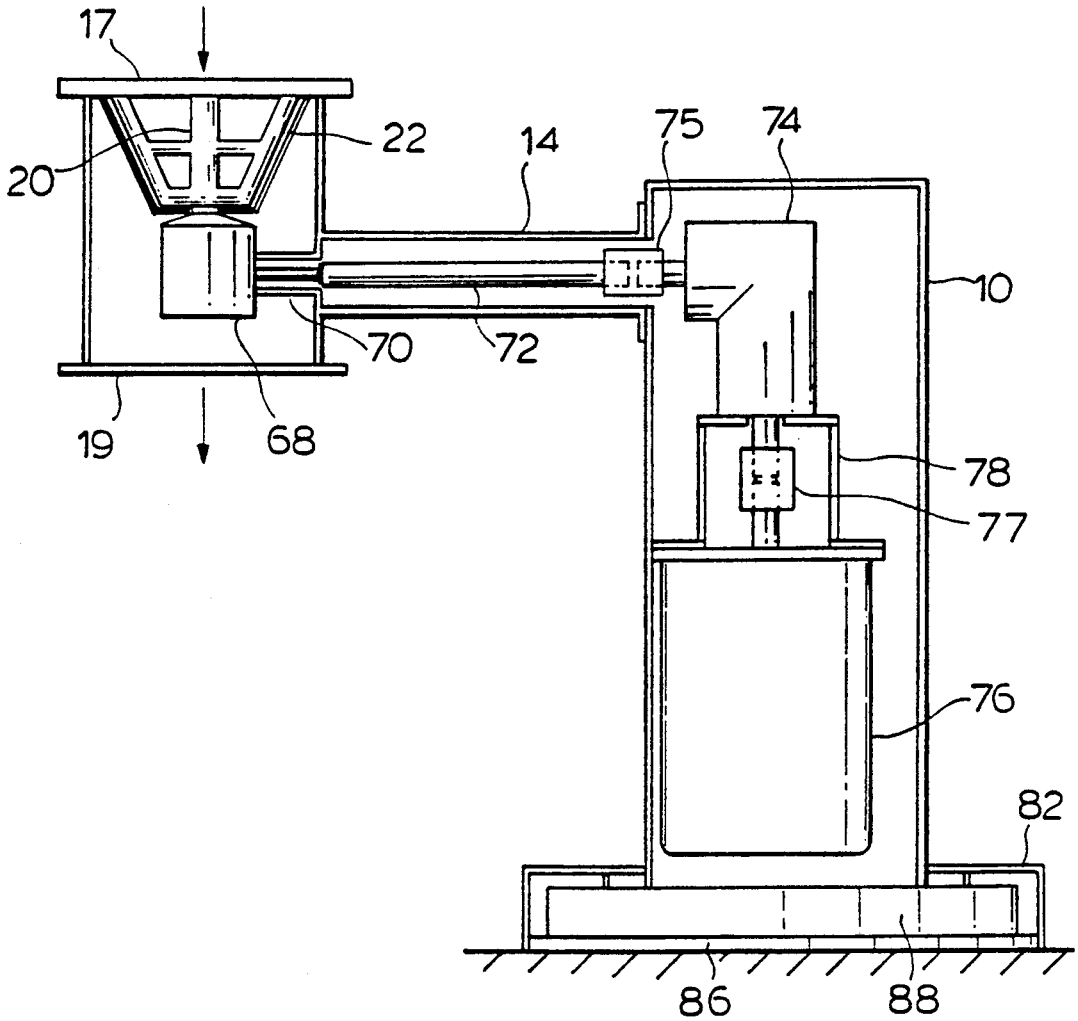
FIG. 2 is a side sectional view of the invention of FIG. 1.

The size reduction machine of the present invention is illustrated generally in FIGS. 1 and 2. The machine generally has a hollow housing 10, a support tube 14, an impeller housing 16, a spindle 18, an impeller 20 and a screen 22.

Screen 22 has a tapered apertured wall 24 formed into a frusto-conical shape with a wide end 26 and a narrow end 28. Both ends 26 and 28 are open. The screen 22 has a circular flange 30 which surrounds and extends outwardly of the wide end 26.

The circumference of circular opening 36 of impeller housing 16 has an outwardly extending flange 38 having a plurality of circumferentially spaced notches 40. The screen 22 is adapted to extend into housing 16 while circular flange 30 abuts with flange 38.

The axis of rotation of spindle 18 is concentric with the center of the circular opening 36 which defines an imaginary vertical axis of the flow of material from the input 17 to the output 19 of the machine as indicated by the arrows in FIG. 2.

The receiving end 46 of spindle 18 has diametrically opposed machined surfaces 48 and is adapted to receive impeller 20. The receiving end 46 has an axially extending threaded bore 50 for receiving bolt 52 for attaching the impeller 20 onto the spindle 18.

Figure 4:
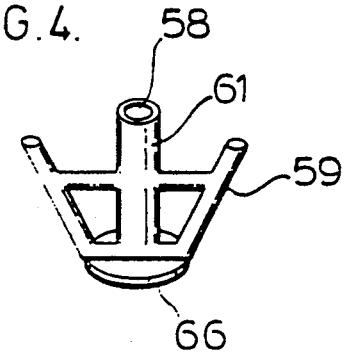
FIG. 4 is a perspective view of the impeller of FIG. 3.
Figure 3:
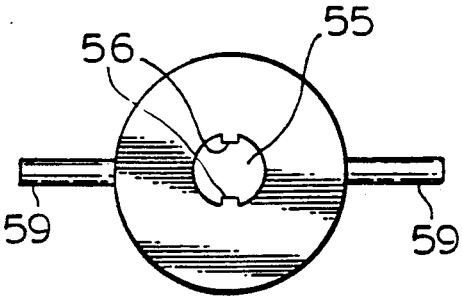
FIG. 3 is a bottom view of the impeller of the invention of FIG. 1.

Referring to FIGS. 3 and 4, impeller 20 has an axially extending central core 61. Impeller 20 is preferably a type having a plurality of blades 59 circumferentially spaced about central core 61. Preferably, the impeller has a circular base plate 66.

The lower end of core 61 has a central bore 55 having complementary abutments 56 for mating with receiving end 46 of spindle 18. The upper end of the central core 61 has a concentric bore 58 adapted to receive bolt 52 and form an interior shoulder with central bore 55.

Although machined surfaces 48 and abutments 56 have been described, any type of engagement surfaces, such as keyways, splines, etc., may be used provided rotational drive can be effectively transmitted from the spindle 18 to the impeller 20.

Figure 5:
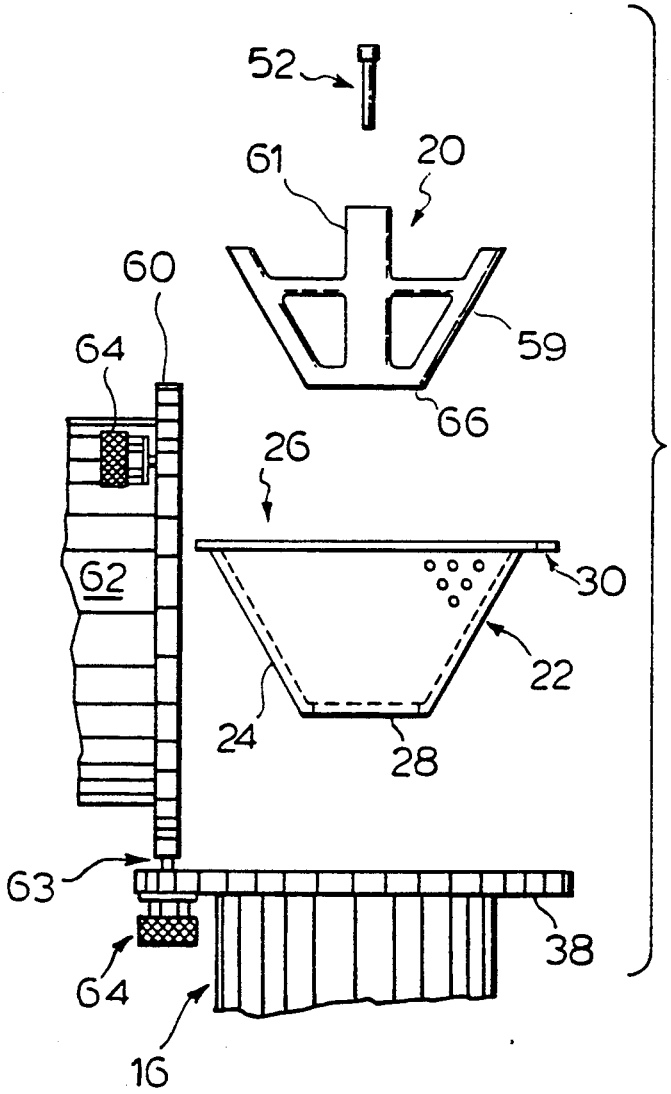
FIG. 5 is an exploded view of the impeller and screen of the invention of FIG. 1.

Referring to FIG. 5, flange 60 of hopper 62 has a plurality of bolts 64 attached to hinges 63 for pivotal attachment thereto. The bolts 64 are circumferentially spaced about the flange 60 to mate with notches 40 of flange 38 of housing 16. A gasket may be used to seal the joint between flanges 38 and 60.

Referring back to FIGS. 1 and 2, spindle 18 is enclosed within a gearbox 68. Gearbox 68 is joined to adaptor 70 having a central bore extending therethrough. Drive shaft 72 extends through adaptor 70 into gearbox 68 at one end in a manner discussed further below. A drive shaft extends through support tube 14 and is coupled to angled gearbox 74 by coupling 75.

Angled gearbox 74 transmits drive about a 90° angle. Angled gearbox 74 is coupled to electric motor 76 via shaft coupling 77 within coupling housing 78. Drive shaft 72 is journalled within support tube 14 in a manner well known in the art. Electric motor 76, coupling 77 and angled gearbox 74 are mounted within hollow housing 10. Hollow housing 10 is provided with an access plate 80 for allowing service to the drive section of the apparatus.

Housing 10 is mounted to bearing cover 82 having brackets 84 for bolting housing 10 thereto. Base plate 86 is provided with a bearing ring 88 adapted to receive bearing cover 82.

When fully assembled, housing 10 may be rotated about a vertical axis 360°, swinging impeller housing 16 into and out of a desired location. Base plate 86 may be bolted to the floor to add stability to the apparatus.

Figure 6:
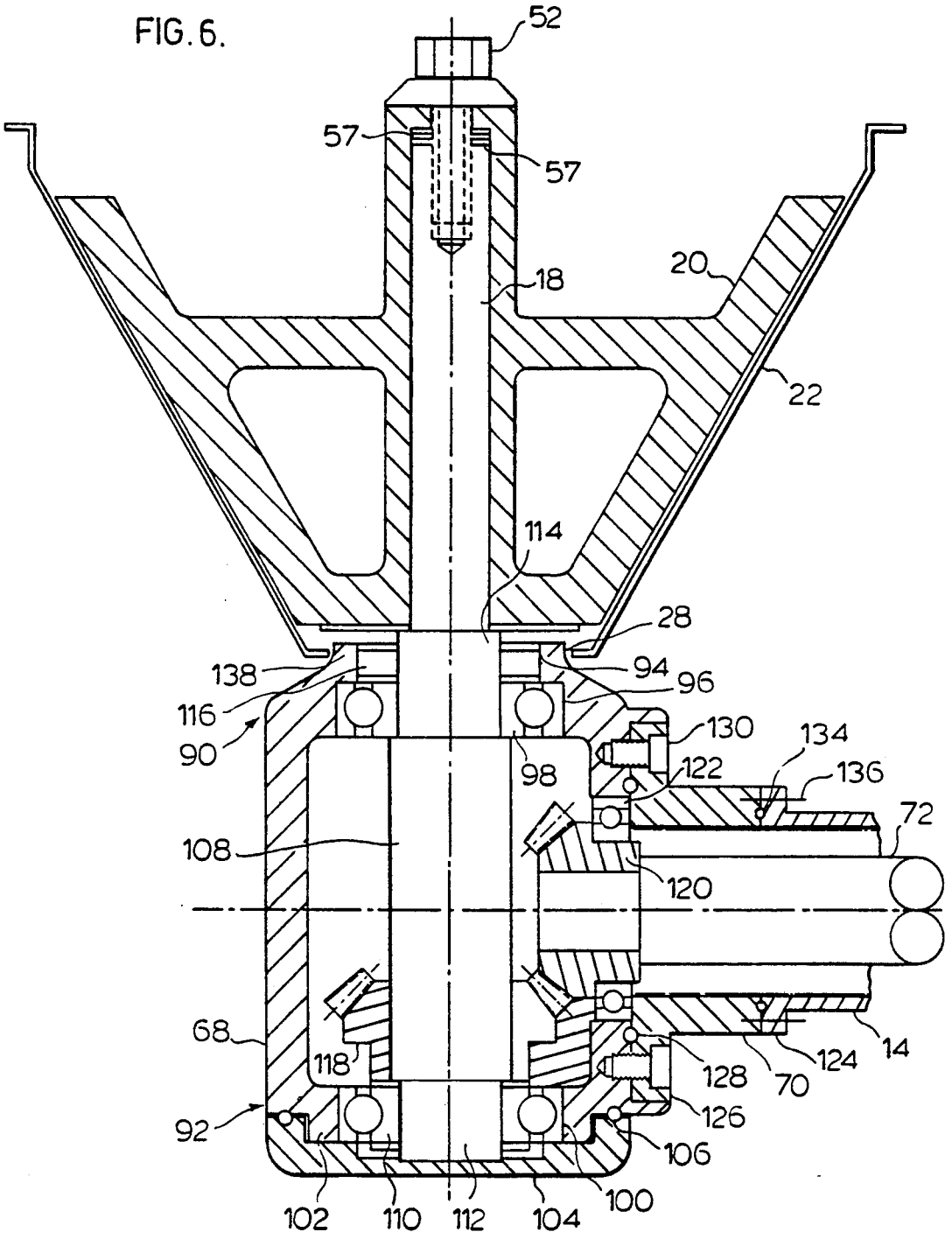
FIG. 6 is a side sectional view of the gearbox and impeller arrangement of the invention of FIG. 1.

Referring to FIG. 6, gearbox 68 is a hollow housing having an upper end 90 and a lower end 92. The upper end 90 has a first bore 94 and a countersunk bore 96 thereunder. The countersunk bore is sized to receive a racer bearing assembly 98 in a friction fit.

The lower end 92 of gearbox 68 has a bore 100 extending therethrough. The lower most end of gearbox 68 has a lip 102 having an external thread thereon. The lower end 92 of gearbox 68 is closable with a cap 104 having an internal threaded bore adapted to threadingly engage thread on the lip formation. An O-ring 106 is mounted within groove on surface to sealingly engage the cap 104 with the gearbox 68.

Cap 104 has a circular recess sized to receive shaft 108. Racer bearing assembly 110 fits with bore 100 in a friction fit.

Spindle 18 is integral with shaft 108. The shaft 108 has two bearing surfaces 112 and 114 spaced to engage the bearing assemblies 110 and 98, respectively, mounted at the upper and lower ends of the gearbox 68. A concentric lip seal 116 is provided in the first bore 94 of the upper end of the gearbox 68 and adapted to seal the bearing surface 114 of the shaft 108 as it rotates. A bevel gear 118 is fixedly mounted on the shaft 108.

Drive shaft 72 has a bevel gear 120 fixedly mounted on the end thereof adapted to engage with the bevel gear 118 mounted on the shaft 108 for drivingly rotating the shaft and ultimately the impeller 20.

Gearbox housing 68 has a circular opening at the side thereof and adapted to receive drive shaft 72. At the mouth of the opening, a bearing 122 is mounted for journalling the drive shaft 72 as it rotates. Adaptor 70 has a flange 126 and is adapted to connect with the gearbox 68 in a sealing fit. An O-ring 128 is provided to properly seal the adaptor 70 to the gearbox 68. Bolts 130 join the adaptor 70 to the gearbox 68.

Support tube 14 has a flange 124 for sealingly engaging adaptor 70. An O-ring 134 seals flange 124 to the adaptor 70. Bolts 136 which are schematically illustrated are used to join the support tube 14 to the adaptor 70. Support tube 14 is also connected to impeller housing 16.

In the preferred embodiment for use in a sanitary environment, all parts are manufactured out of stainless steel. The bevelled gears are greased for life of the apparatus.

The upper end of gearbox 68 is provided with a lip formation 138. The screen 22 has a lower opening 28. The lower opening 28 is sized to frictionally fit about the lip formation of gearbox 68.

Referring to FIGS. 3 and 4, impeller 20 preferably has a base disc 66. In use, the base disc 66 acts to direct the flow of material outwardly and away from the lip seal 116, thereby minimizing the possibility of milled material from entering the gearbox 68.

Washer shaped spacers 57 which are sized to fit within concentric bore 58 and receive bolt 52. Spacers 57 are used to set the gap between the impeller blade 59 and the interior of wall 24 of screen 22 in a manner well known in the art.

Once a screen and impeller have been selected, the operation and efficiency of the machine depends upon the gap between the impeller and the interior wall surface of the screen. The different wall thicknesses of the screen are compensated for by inserting or removing spacers 57 on the spindle 18 to move the impeller 20 relative to the interior wall surface of the screen 22. Since the wall 24 of the screen is tapered relative to the impeller 20, the actual adjustment of the gap is less than the thickness of the spacer 57 and depends upon the angle of the screen relative to the horizontal. Since the tapered wall of the screen has a known angle relative to the horizontal, the gap is adjusted by inserting spacers having known thicknesses that will effect the desired gap.

The gap between the impeller 20 and the screen 22 is critical for producing a final milled product of consistent particle size. If the gap is too large, there is a loss of capacity or throughput, screen binding and a change in particle size. If no gap exists between the impeller and the screen, the screen and the impeller will become worn or burned and in the extreme, the impeller will not rotate.

To assemble the size reduction machine, screen 22 is selected and placed in impeller housing 16. A gasket may be placed circumferentially over the wide end 26 of screen and presented to flange 38 of housing 16. Impeller 20 is presented to receiving end of 46 of spindle 18. Spacers 57 are selected depending on the desired gap and are presented to spindle 18. Bolt 52 is presented to bore 58 of impeller 20 to engage threaded bore 54 of spindle 14. Bolt 52 is tightened, urging impeller 20 against spacers 57 against receiving end 46 of spindle 18 thereby setting the gap between the impeller blades 59 and the screen 22.

Hopper 62 is pivoted and introducing the bolts 64 into notches 40 releasably attaching the hopper 62 to the housing 16. Once assembled, the entire machine is rotated until the input 17 and output 19 are in a desired alignment with other material handling apparatus.

In use, product to be milled is introduced into hopper 62 substantially in-line with the imaginary central axis of the flow of material. The product enters the housing 16 at input 17, falls through housing 16 past the rotating impeller 20, outwardly through screen 22 and downwardly through housing to exit through output 19.

While the invention herein has been described in connection with exemplary embodiments, it will be understood that many modifications will be apparent to those skilled in the art.

We claim:

1. A size reduction machine for use in process industries to continuously and precisely reduce the size of particles, while controlling fines, said machine comprising an impeller mounted on a rotatable spindle, a drive means operably connected to said spindle for effecting rotation of said spindle, said spindle and impeller being vertically mounted within a vertically extending channel having an input and an output, a screen having a tapered apertured wall formed in a frusto-conical shape, said screen rigidly mounted within said channel so that any particles passing from said input to said output pass through said screen, said impeller being shaped and mounted so that a gap between an edge of said impeller and an interior of said screen remains substantially constant as said impeller rotates relative to the screen, wherein the improvement comprises said drive means for drivingly rotating said spindle is operably connected to said spindle at a point under where said impeller is mounted onto said spindle, said drive means extending into said channel and that portion of the drive means which extends into said channel is fully enclosed and sealed within a gearbox housing, substantially preventing ingress and egress of said particles into and out of said gearbox housing, said gearbox housing comprises a hollow body having an upper end having a bore and an internal counterbore and a first racer bearing fitted within said internal counterbore, a lower end having a sealable and closable opening and a second racer bearing fitted within said sealable and closable opening, said spindle rotatably mounted within said first and second racer bearings, a lip seal fitted within said bore for sealingly engaging said spindle, a side wall having an opening for sealingly receiving a hollow adaptor for supporting said gearbox, said adaptor mounted about an aperture in a wall of said channel providing access therethrough for said drive means.

2. The size reduction machine as claimed in claim 1 wherein said screen has a narrow end having an aperture adapted to frictionally fit about said upper end of said gearbox for closing said narrow end.

3. The size reduction machine as claimed in claim 2 wherein said impeller has a base having a circular disc for directing flow of said particles outwardly towards said screen as said impeller rotates.

4. The size reduction machine as claimed in claim 1 wherein said drive means comprises a motor mounted within a housing remote from said channel, said motor operably connected to a drive shaft adapted for drivingly engaging said spindle.

5. The size reduction machine as claimed in claim 4 wherein said spindle has a driven gear mounted thereon and said drive shaft has a driving gear mounted thereon.

6. The size reduction machine as claimed in claim 5 wherein a tube extends between said wall of said channel and said housing and said drive shaft extends within said tube.

7. The size reduction machine as claimed in claim 6 wherein said housing is rotatably mounted for swinging said machine into and out of a path of particles.

8. A size reduction machine for use in process industries to continuously and precisely reduce the size of particles, while controlling fines, said machine comprising an impeller mounted on a rotatable spindle, a drive means operably connected to said spindle for effecting rotation of said spindle, said spindle and impeller being vertically mounted within a vertically extending channel having an input and an output, a screen having a tapered apertured wall formed in a frusto-conical shape, said screen rigidly mounted within said channel so that any particles passing from said input to said output pass through said screen, said impeller being shaped and mounted so that a gap between an edge of said impeller and an interior of said screen remains substantially constant as said impeller rotates relative to the screen, wherein the improvement comprises said drive means for drivingly rotating said spindle is operably connected to said spindle under where said impeller is mounted onto said spindle, said drive means extending into said channel and that portion of the drive means which extends into said channel is fully enclosed and sealed within a gearbox housing, substantially preventing ingress and egress of said particles into and out of said gearbox housing, said gearbox housing comprises a hollow body having an upper end having a bore and an internal counterbore, a lower end having a sealable and closable opening, a side wall having an opening for sealingly receiving a hollow adaptor for supporting said gearbox, said adaptor mounted about an aperture in a wall of said channel and providing access for a drive shaft of said drive means, a lip seal fitted within said bore for sealingly engaging said spindle, a first racer bearing fitted within said internal counterbore, a second racer bearing fitted with said opening, said spindle is rotatably mounted within said first and second racer bearings, said drive shaft drivingly engages said spindle, said screen has a narrow end having an aperture adapted to frictionally fit about said upper end of said gearbox for closing said narrow end, and said impeller has a base having a circular disc for directing flow of said particles outwardly towards said screen as said impeller rotates.

* * * * *